US009334101B2

(12) United States Patent
Janis et al.

(10) Patent No.: US 9,334,101 B2
(45) Date of Patent: May 10, 2016

(54) PACKAGING WITH MULTIPLE FUNCTIONS AFTER OPENING

(71) Applicant: Apple Inc., Cupertino, CA (US)

(72) Inventors: Andrew J. Janis, Cupertino, CA (US); Fletcher R. Rothkopf, Los Altos, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/500,444

(22) Filed: Sep. 29, 2014

(65) Prior Publication Data

US 2015/0047993 A1 Feb. 19, 2015

Related U.S. Application Data

(63) Continuation of application No. 13/099,013, filed on May 2, 2011, now abandoned.

(51) Int. Cl.

| | |
|---|---|
| ***B65D 85/00*** | (2006.01) |
| ***B65D 81/36*** | (2006.01) |
| ***B65D 5/52*** | (2006.01) |

(52) U.S. Cl.

CPC *B65D 81/36* (2013.01); *B65D 5/52* (2013.01); *B65D 2585/6837* (2013.01)

(58) Field of Classification Search

CPC ..... G06F 1/1626; A45C 13/002
USPC ..... 206/45.2, 320
See application file for complete search history.

(56) References Cited

U.S. PATENT DOCUMENTS

| | | | |
|---|---|---|---|
| 993,330 | A | 5/1911 | Walker |
| 3,127,010 | A | 3/1964 | Capezzuto |
| 4,946,057 | A | 8/1990 | Connolly et al. |
| 5,163,547 | A | 11/1992 | Hsieh |
| 5,775,511 | A | 7/1998 | Stark |
| D411,448 | S | 6/1999 | Baker |
| D558,571 | S | 1/2008 | Andre et al. |
| D580,752 | S | 11/2008 | Andre et al. |
| D584,142 | S | 1/2009 | Andre et al. |
| D596,485 | S | 7/2009 | Andre et al. |
| 7,694,932 | B1 | 4/2010 | Ngan |
| D620,795 | S | 8/2010 | Andre et al. |
| D621,256 | S | 8/2010 | Andre et al. |
| 7,775,356 | B2 | 8/2010 | Palmer |
| D628,562 | S | 12/2010 | Akana et al. |
| D631,468 | S | 1/2011 | Akana et al. |
| D633,476 | S | 3/2011 | Andre et al. |

(Continued)

OTHER PUBLICATIONS

Packaging Box Printing. <http://www.printingcompanies-image.com/Products/Productshow_233.html>. Retrieved Jul. 25, 2011. 2 pages.

*Primary Examiner* — King M Chu
(74) *Attorney, Agent, or Firm* — Sterne, Kessler, Goldstein & Fox P.L.L.C.

(57) ABSTRACT

Packaging including a base and a removable lid for the base. The lid is configured for multiple configurations including a first configuration for storing an item and a second configuration for supporting the lid in a substantially upright orientation for displaying the item. Attachment supports can be included in the base for securing the stand in the upright orientation. Lid supports can be included in the attachment support to support the lid. Alternatively or additionally, an insert having a living hinge can be used to support the lid. The base may be substantially rigid or may be configured to be collapsible or to otherwise allow for multiple configurations.

10 Claims, 15 Drawing Sheets

(56) References Cited

U.S. PATENT DOCUMENTS

| | | | | |
|---|---|---|---|---|
| D634,304 | S | 3/2011 | Andre et al. | |
| 2006/0058081 | A1* | 3/2006 | Reichenbach | B60R 11/0241 455/575.8 |
| 2007/0199862 | A1 | 8/2007 | Kim et al. | |
| 2007/0215663 | A1* | 9/2007 | Chongson | A45C 1/04 224/650 |
| 2008/0185312 | A1 | 8/2008 | Geurts et al. | |
| 2009/0314400 | A1* | 12/2009 | Liu | 150/165 |
| 2010/0078343 | A1* | 4/2010 | Hoellwarth et al. | 206/320 |
| 2011/0049005 | A1* | 3/2011 | Wilson et al. | 206/701 |

* cited by examiner

PACKAGING WITH MULTIPLE FUNCTIONS AFTER OPENING

CROSS-REFERENCE TO RELATED APPLICATION

This application is a continuation of U.S. patent application Ser. No. 13/099,013, filed May 2, 2011, titled "Packaging With Multiple Functions After Opening," which is incorporated herein in its entirety by reference thereto.

BACKGROUND

1. Field

The present invention generally relates to packaging, and more particularly, to packaging for an article of manufacture.

2. Background

Products are often enclosed in packaging for distribution and sale. Conventionally, packaging has been designed to provide benefits such as physical protection of the product, aesthetic appeal to the consumer, and convenience during distribution and handling.

Conventional packaging materials, such as boxes, blister packs, and clamshell packaging are typically thrown away once the product is opened. Such single use packaging can be inefficient, and such waste can have a negative environmental impact by accumulating in landfills and elsewhere in the environment.

BRIEF SUMMARY

The present invention provides for packaging with multiple uses and functions after opening. In one embodiment, the packaging includes a base and a removable lid, wherein the lid is configured to be disposed on the base in two configurations: a first, storage configuration in which the lid and base create a cavity for storing an item, and a second, display configuration in which the lid is disposed in the attachment support to fixedly support the lid in a substantially upright orientation for displaying an item resting on the lid between the lid and base, and wherein the attachment support is configured to raise the lid above the base to create a gap under the lid when the lid is in its second configuration.

In another embodiment, the packaging includes a base including an interior space; and an attachment support disposed in the interior space, wherein the packaging is configured to support an item in two configurations, a first, storage configuration in which the item is securely stored within the interior space, and a second, display configuration in which the item is supported by the attachment support to fixedly support the item in a substantially upright orientation for displaying the item, and wherein the attachment support is configured to raise the item above the base to create a gap between the item and the base when the item is in its second configuration.

Additional features of the invention will be set forth in the description that follows, and in part will be apparent from the description, or may be learned by practice of the invention. Both the foregoing general description and the following detailed description are exemplary and explanatory and are intended to provide further explanation of the invention as claimed.

BRIEF DESCRIPTION OF THE FIGURES

The accompanying figures, which are incorporated herein, form part of the specification and illustrate exemplary embodiments of the present invention. Together with the description, the figures further serve to explain the principles of, and to enable a person skilled in the relevant art(s) to make and use the exemplary embodiments described herein.

DETAILED DESCRIPTION

The following detailed description refers to the accompanying figures, which illustrate exemplary embodiments. Other embodiments are possible. Modifications can be made to the exemplary embodiments described herein without departing from the spirit and scope of the present invention. Therefore, the following detailed description is not meant to be limiting. The operation and behavior of the embodiments presented are described with the understanding that modifications and variations may be within the scope of the present invention.

Figure 1:
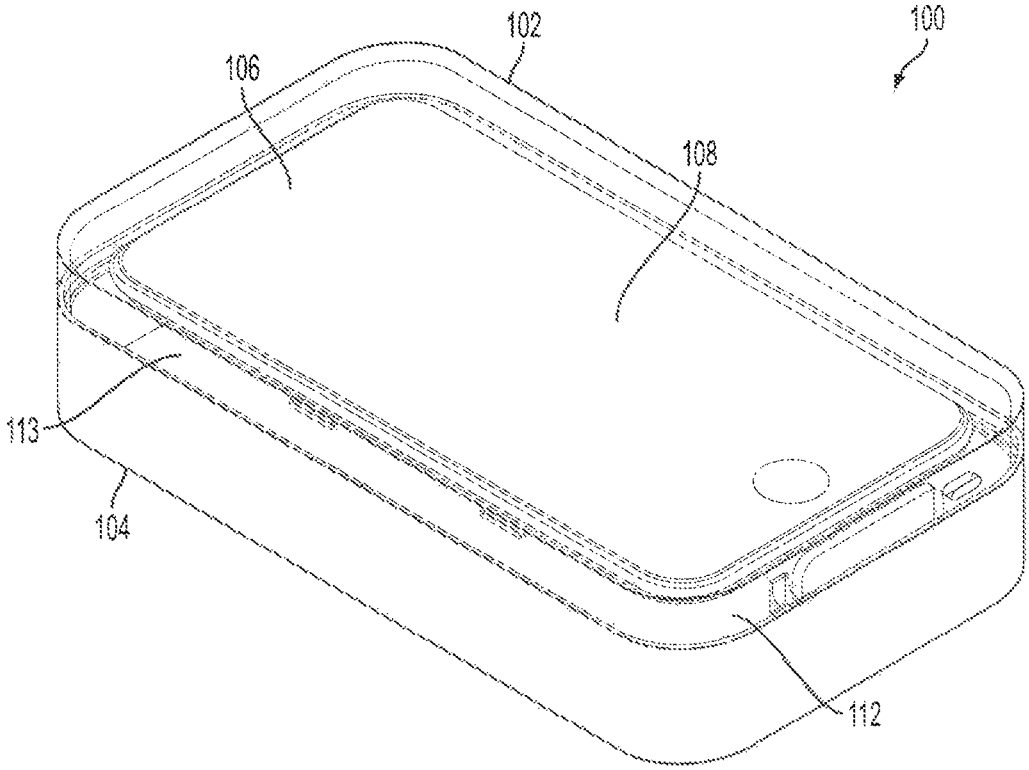
FIG. 1 is a front perspective view of packaging of an exemplary embodiment of the present invention in a packaging configuration.

FIG. 1 is a front perspective view of packaging 100 assembled in a packaging configuration. Packaging 100 comprises a lid 102 disposed on top of a base 104 to substantially enclose an interior space formed by the inner surfaces of lid 102 and base 104. The packaging configuration is configured to allow item 106 to be securely supported within lid 102 and base 104 during transport, retail sale, or other display. In use, an individual opens packaging 100 by removing lid 102 from base 104. Once lid 102 is removed, the individual can remove item 106 from base 104. A display configuration, described below, is configured to support an item upright, similar to conventional docking stations.

Lid 102 includes a substantially planar surface 110 surrounded by a plurality of short planar side walls 112 and long planar side walls 113 at right angles to surface 108, which together along with base 104 enclose item 106. Lid 102 is sized to accommodate item 106, which may, for example, be an iPhone® smart phone, or iPod Touch®, which are produced by Apple Inc. of Cupertino, Calif. One model of the iPhone® is shown in U.S. Pat. No. D618,204. Another model of an iPhone® smart phone is shown in U.S. Pat. No. D627,778. The size, shape, and weight of the item can vary widely. In particular, the dimensions of packaging 100 can alternatively be sized to accommodate portable entertainment devices such as an MP3 player or smart phone, computer tablets such as the iPad®, or any other suitable device one wishes to both package and display.

In addition, packaging 100 can be adapted to accommodate items much larger or much smaller than portable handheld electronic devices. For example, the lid can also be adapted to accommodate non-electronic products, such as a book, a picture frame, or any other suitable product. In particular, packaging 100 can be adapted to accommodate relatively complex shapes such as a cylinder, or other, non-geometric shapes. Lid 102 is shaped to substantially follow the form of an outside profile of the item 106. Lid 102 can alternatively be shaped to substantially follow the form of a portion of an outside profile of item 106, such as the bottom half of item 106.

Side walls 112 of lid 102 include a step 114 configured to mate with a corresponding ledge 116 formed in base 104 when lid 102 is assembled in its packaging configuration. This step and ledge interface can provide for a relatively flush juncture 118 between the outer surface of lid 102 and base 104 when packaging 100 is assembled in its packaging configuration. The step and ledge interface additionally provides a relatively snug and stable fit between lid 102 and base 104.

In other embodiments, lid 102 can be supported by an item located within base 104 in addition to or instead of by ledge 116. In one embodiment, the width and length of lid 102 can be slightly larger than the width and length of base 104 so that lid 102 fits snugly over base 104. In addition, or in the alternative, lid 102 can engage with base 104 via snaps, latches, spring detents, magnets, or the like. Other more permanent attachment means can be used, such as adhesive that provides for permanent or removable attachment between lid 102 and base 104.

Item 106 is supported on an insert 107 in packaging 100. Insert 107 is a substantially planar, rectangular, thin piece of plastic and is described in further detail below. Insert 107 rests on ledge 116 in base 104 but can alternatively or additionally be supported by another part of base 104 or by items disposed within base 104.

Lid 102 and base 104 are shown as transparent to allow an individual to see item 106 without needing to remove lid 102 from base 104. However, either can be transparent, translucent, opaque, or any combination or degree thereof.

In one embodiment, at least a portion of a front surface of lid 102 is made semitransparent or transparent so that a portion or the entire front of item 106 can be seen through lid 102 when packaging 100 is in its packaging configuration. In one embodiment, at least a portion of surface 108 as well as any other surface are made semitransparent or transparent so that a portion or the entire front and side of item 106 can be seen. In one embodiment, all sides of packaging 100 are made semitransparent or transparent.

The various pieces of packaging 100 can be colored or tinted, and can include design elements such as, for example, graphics or print. Transparency can be used in order to more fully display item 106 when packaging 100 is in its packaging configuration. Opacity can be used in order to hide an interior of packaging 100 or to hide a portion of item 106. Color or design or lack thereof can be used to impact aesthetic appeal. Graphics or print can be used in order to convey information about item 106 or to impact aesthetic appeal. Alternatively or additionally, a technique such as, for example, physical vapor deposition can be used to achieve a desired surface appearance, such as, for example, a mirrored look. Any or all of these techniques can be used on only a portion of one or more parts of packaging 100 or over the entire surface of packaging 100 in order to achieve a desired look.

The various parts of packaging 100 can be formed of any suitable material such as rigid plastic, including polycarbonate and polyethylene terephthalate (PET), aluminum, or paper, and can be any suitable thickness. The various parts of packaging 100 can be formed through a variety of processes, including, for example, machining or thermoforming. The suitability of any particular manufacturing process can be influenced by the desired characteristics, as would be understood from the description provided herein. For example, in one embodiment, lid 102 is formed from a flat sheet of PET stock having a thickness in the range of 0.1 mm to 0.8 mm. During manufacturing, the PET stock is heated and drawn into a vacuum mold in a thermoforming process in order to form a cavity. In order to facilitate production in this manner, one or more surfaces of the lid include a draft angle θ, which can be, for example, 0.25 to 3 degrees. Openings in lid 102 can be created by a punch operation. Due to the nature of the thermoforming process, various areas of lid 102 may not have a constant thickness. For instance, side walls 112 of lid 102 may be thicker than support surface 110 of lid 102.

Figure 2:
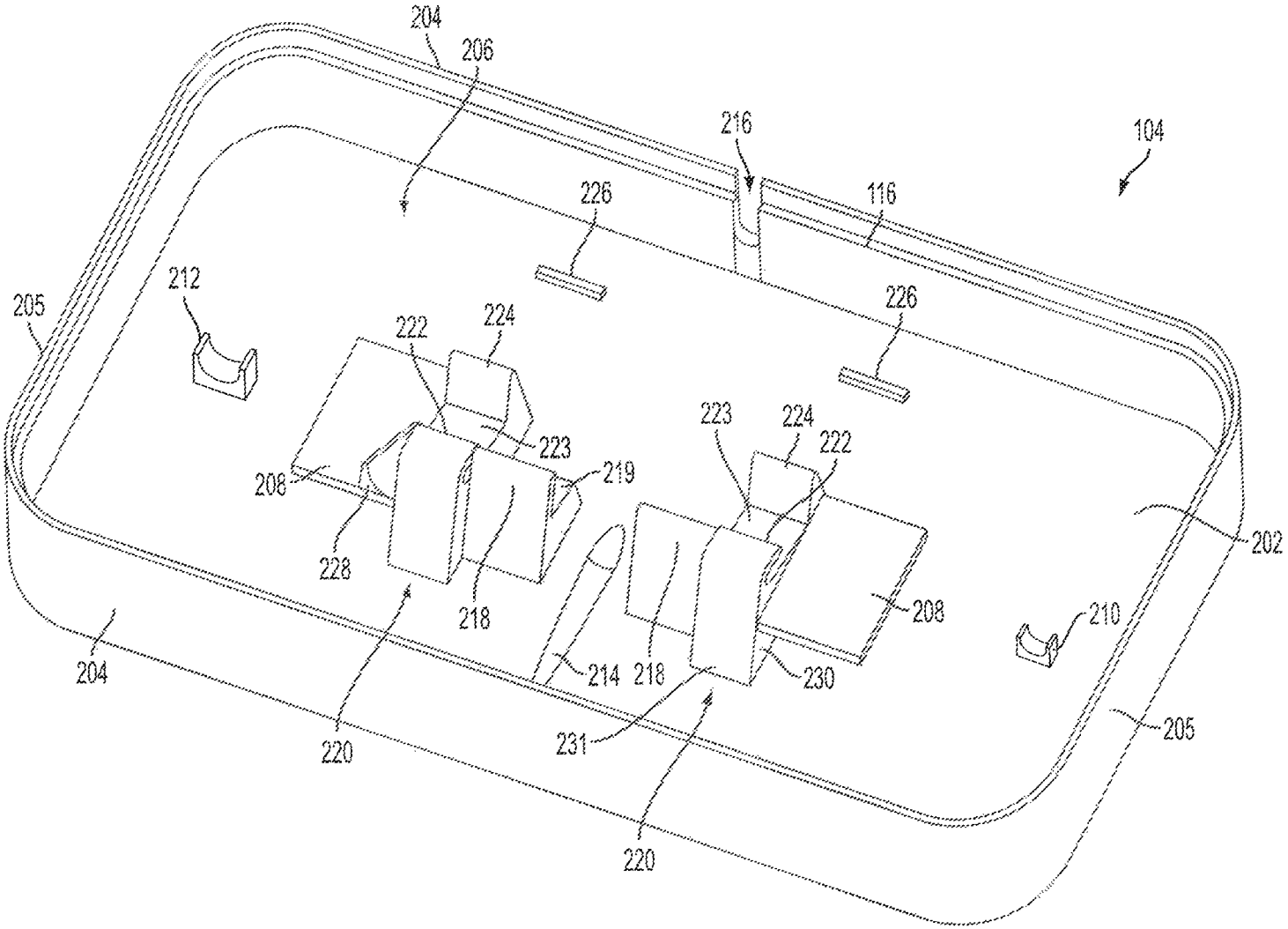
FIG. 2 is a front perspective view of the base of the packaging of FIG. 1.

Referring now to FIG. 2, base 104 is shown. Like lid 102, base 104 includes a substantially planar surface 202 surrounded by a plurality of side walls 204 forming a cavity 206. The dimensions of base 104 correspond to the dimensions of lid 102. However, in alternative embodiments, base 104 can have different dimensions than lid 102. Base 104 includes features designed to accommodate item 106 and accessories for item 106, such as headphones, a power or data cord, or the like. For example, attachment supports 220 each include a flange 208 projecting from the sides of attachment supports 220 that allow a user to wrap headphones around attachment support 220 underneath flange 208 to prevent the cord from slipping off attachment supports 220. This arrangement allows for relatively secure storage or transport of the headphones.

Base 104 includes a projection 210 which is sized to securely receive a power cord for attaching to item 106. Base 104 also includes projection 212, which is sized to securely receive a headphone jack, such as a ¼ inch or 3.55 mm jack.

Base 104 includes groove 214 which is configured to accommodate a portion of the power cord to align the cord and provide room for the cord to attach to item 106. In other embodiments, base 104 includes tunnels or compartments through which cords or other items or accessories can be passed or stored. Base 104 also includes a cord opening 216 operatively sized to allow a cord to pass through side wall 204 of base 104 to its exterior.

Base 104 includes a plurality of plug supports 218 having a support surface 219 elevated above base 104 and sized to support and align a dock connector (shown for example in FIG. 6) to be plugged into item 106 in a substantially upright orientation above the base and to stabilize the connection therebetween. Plug supports 218 are sized to support a 30-pin connector, which is commonly used on products produced by Apple Inc., such as the iPod®, iPhone® and iPad®. In other embodiments, plug supports are sized to support alternative plugs, such as a mini- or micro-USB connectors. Any other plug for charging, data transfer, or other suitable use, may be used.

Base 104 includes attachment supports 220 for supporting lid 102 when lid 102 is assembled in its display configuration. The display configuration is described in further detail with respect to FIGS. 4 and 5. Attachment supports 220 protrude from a central area of planar surface 202 of base 104 and can be in the form of two rectangular, solid pieces having a short side 231 and a long side 230. Attachment supports 220 may alternatively be hollow, or any other suitable configuration. Any suitable thickness for attachment support 220 can be used. Attachment supports 220 are oriented such that long side 230 runs parallel to short side wall 205 of base 104. In alternative embodiments, attachment supports 220 can be oriented such that long side 230 runs perpendicular or at another angle relative to short side wall 205 of base 104. Attachment supports 220 can alternatively be in the form of a single piece of material either connected by a bridge or other piece of material, or can be in the form of a single attachment support 220 located within base 104. In another embodiment, base 104 does not include a cavity, and attachment supports 220 are located on top planar surface 202 of base 104. Attachment supports 220 include a hook 222, which is described in further detail in the description of FIG. 3, which may be a curved or bent piece of rigid material configured to removably retain side wall 112 of lid 102 between hook 222 and recessed support surface 234, as described below. However, any other suitable attachment means, such as a tongue-and-groove arrangement, a friction fit arrangement, snaps, latches, spring detents, magnets, or the like can alternatively or additionally be used. Other more permanent attachment means can be used, such as adhesive for example, which provides for permanent or removable attachment between attachment supports 220 and lid 102.

Base 104 includes mating connection openings 226 which are configured to receive mating connections of an insert for attaching the insert to the bottom of base 104. This configuration is described in further detail in the description of FIG. 9. Base 104 further includes acoustic amplifier 228, which is described in further detail in the description of FIG. 7.

Figure 3:
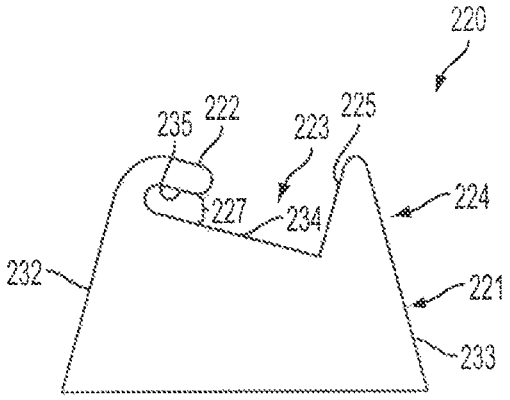
FIG. 3 is a cross-sectional view of the attachment support of FIG. 1.

Referring now to the cross-section of one of attachment supports 220 shown in FIG. 3, attachment support 220 includes a support base 221 having an inclined front wall 232 and a vertical back wall 233. Front wall 232 may alternatively be vertical or any other suitable angle or shape. Back wall 233 may alternatively be inclined or any other suitable angle or shape. Support base 221 includes two protrusions, hook 222 and lid support 224, defining a recess 223 and recessed support surface 234 located therebetween. The first protrusion, or hook 222, is in the form of a cantilever beam projecting from the top of support base 221. Hook 222 extends over recessed support surface 234 creating a groove 227 between bottom surface 235 of hook 222 and recessed support surface 234. Groove 227 is sized to securely receive short side wall 112 of lid 102. The second protrusion, or lid support 224, is in the form of a triangular shaped protrusion having an inclined front surface 225 for supporting the back surface 108 of lid 102 for increased stability between lid 102 and attachment support 220 to reduce pressure on hook 222. Likewise, recessed support surface 234 is sloped to create a right angle between recessed support surface 234 and flat surface 225 of lid support 224 in order to increase the stability of lid 102 when lid 102 is supported within attachment support 220.

Figure 4:
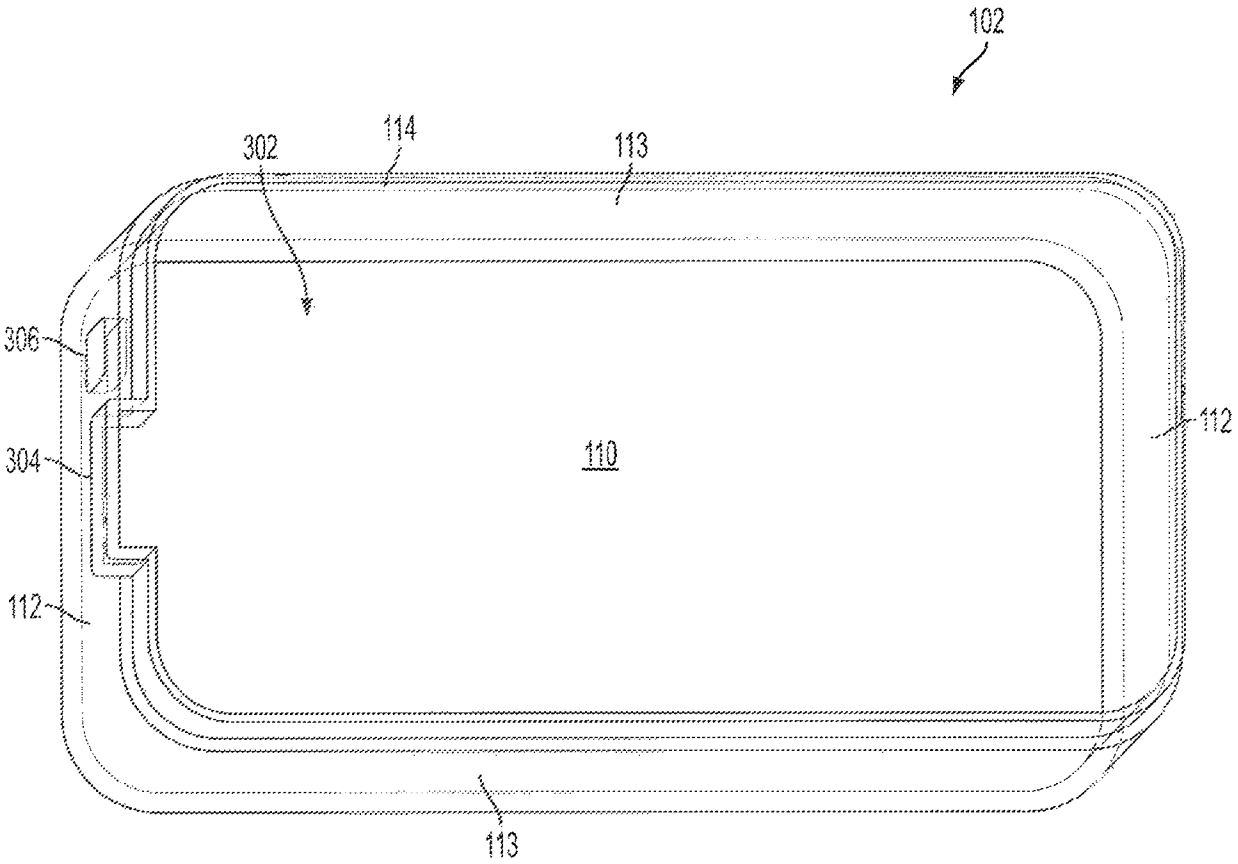
FIG. 4 is a front perspective view of the lid of the packaging of FIG. 1.

Referring now to FIG. 4, lid 102 includes a cavity 302 formed by support surface 110 and side walls 112 and 113. Lid 102 further includes an opening 304 in short side wall 112 to accommodate a dock connector when used in the display configuration. Opening 304 in particular permits item 106 to be plugged in from the bottom of item 106 when the bottom is resting on lid 102. Opening 304 may be disposed at either side wall 112. Lid 102 also includes an acoustic opening 306, which is described in further detail with respect to FIG. 7.

In its display configuration, lid 102 is disposed within cavity 206 formed in base 104 and coupled to base 104 via attachment supports 220 to form a docking station for display or interaction with item 106. In particular, lid 102 is configured to support item 106 slanted in an upright and lengthwise orientation. In another embodiment, lid 102 is configured to support item 106 in a slanted upright widthwise i.e., landscape, orientation.

Accessories (not shown), such as plastic or paper inserts, power cords, earphones, USB connectors, and the like, or warranties and instruction manuals can be stored inside cavity 206 of base 104 in either the display or packaging configuration. They can be marked with identifying words or pictures to convey information to the consumer about the product inside the packaging or other information. They can be shaped to conform to the shape of base 104 and sized to fit snugly in the interior thereof. In one embodiment, the items are opaque so that any items stored within are not visible when inside packaging 100.

Figure 5:
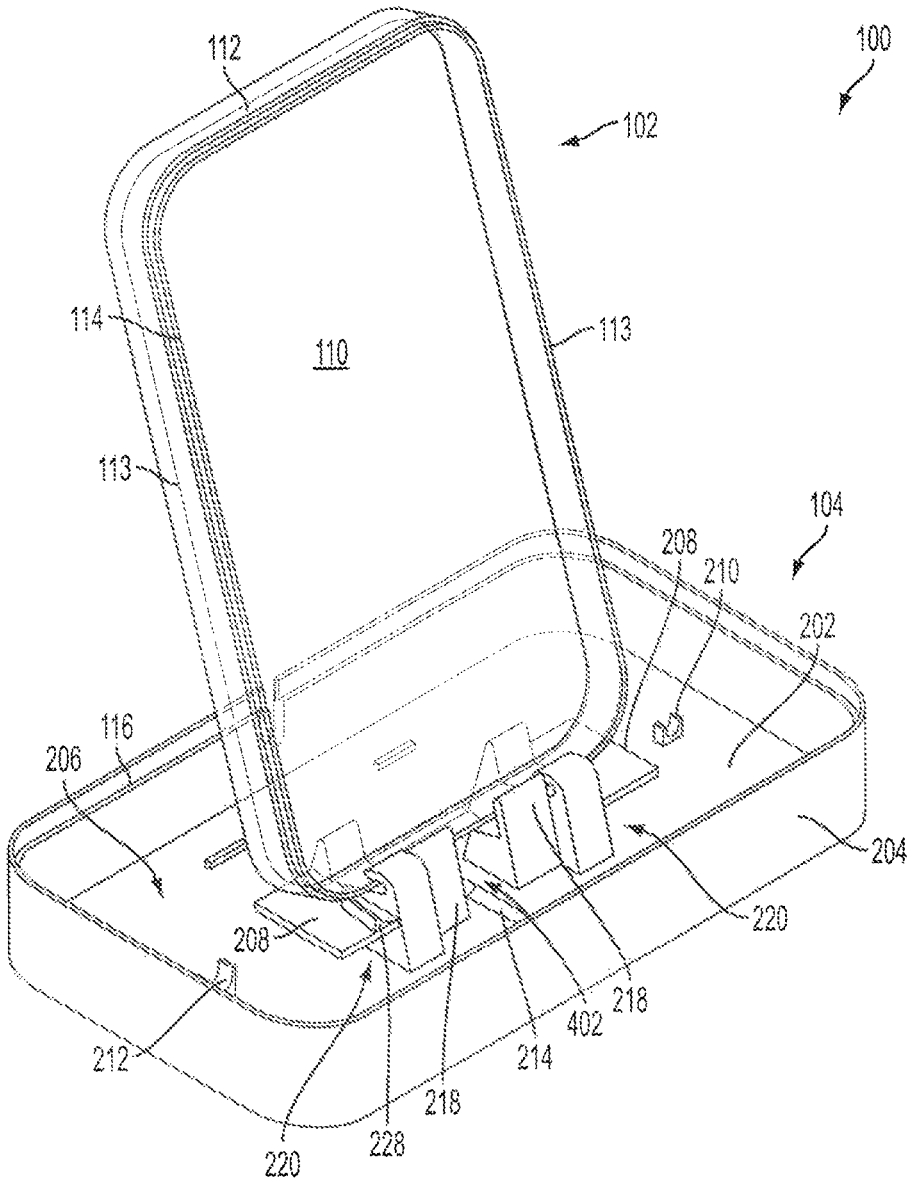
FIG. 5 is a front perspective view of the packaging of FIG. 1 in a display configuration.

FIG. 5 is a front perspective view of the packaging of FIG. 1 in a display configuration. In use, short side wall 112 of lid 102 is placed within groove 227 formed by hook 222 in attachment support 220. Hook 222 serves to securely support short side wall 112. Short side wall 112 is further supported by angled recessed support surface 234 and inclined surface 225 of lid support 224 so that lid 102 is displayed in a substantially upright orientation. Once lid 102 is supported within attachment support 220, an individual may place item 106 within cavity 302 of lid 102 to be displayed within lid 102. Attachment support 220 is configured to raise lid 102 above base 104 to create a gap 402 between wall 112 of lid 102, top surface 202 of base 104, and between attachment supports 220 to receive a plug (shown for example in FIG. 6). In particular, gap 402 is sized to permit item 106 to be plugged in from the bottom of item 106 when the bottom is resting on lid 102.

Figure 6:
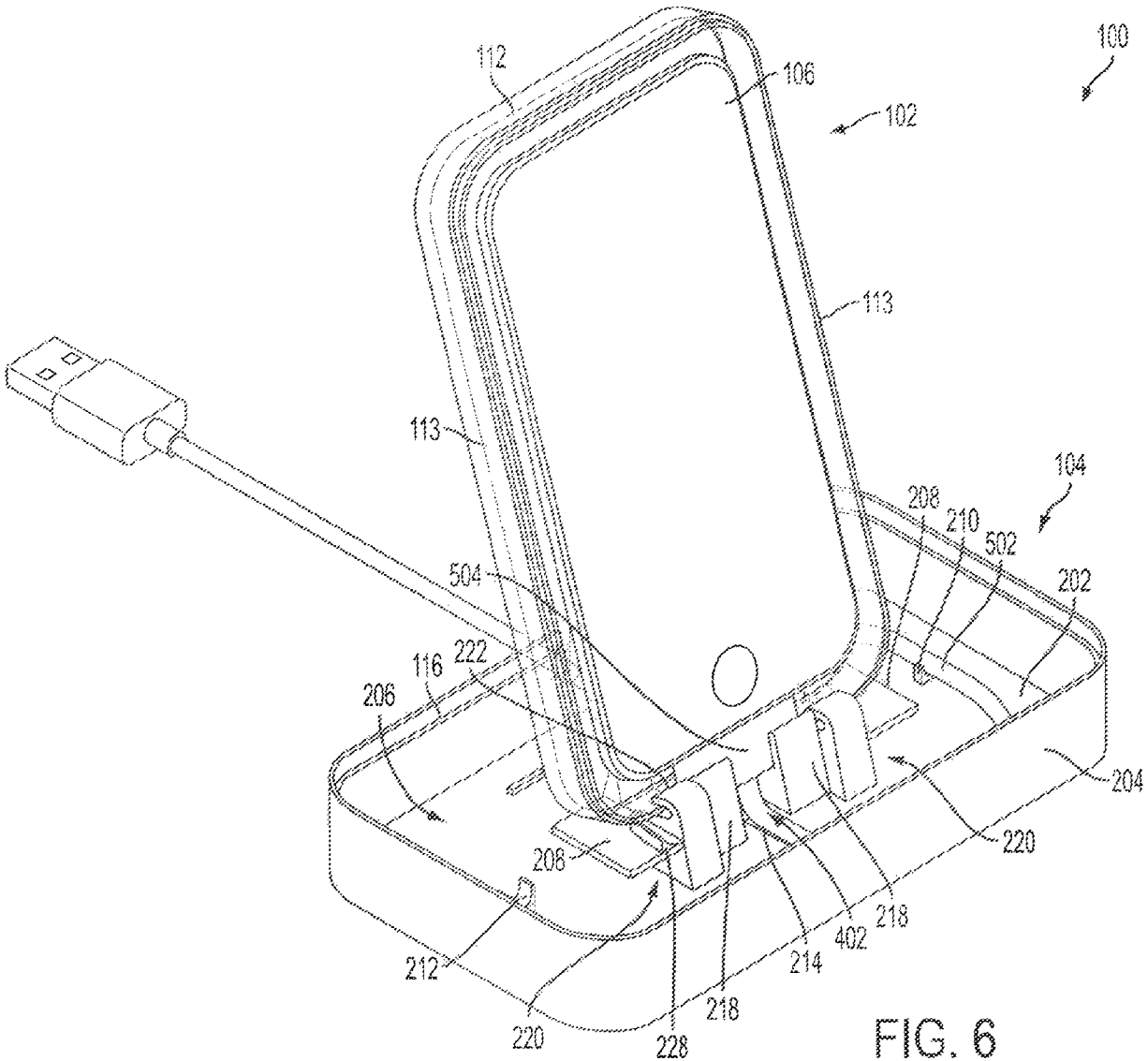
FIG. 6 is a front perspective view of the packaging of FIG. 1 in a display configuration with an item and a power cord disposed therein.

FIG. 6 is a front perspective view of packaging 100 in a display configuration with item 106 and a power cord 502 disposed therein. Power cord 502 is passed through cord opening 216 of base 104 and secured in place by projection 210. Power cord 502 can be wrapped around the front of attachment supports 220 and is supported by plug support 218. Packaging 100 can also accommodate other arrangements of power cord 502. Dock connector 504 is located within gap 402 and plugged into item 106.

Figure 7:
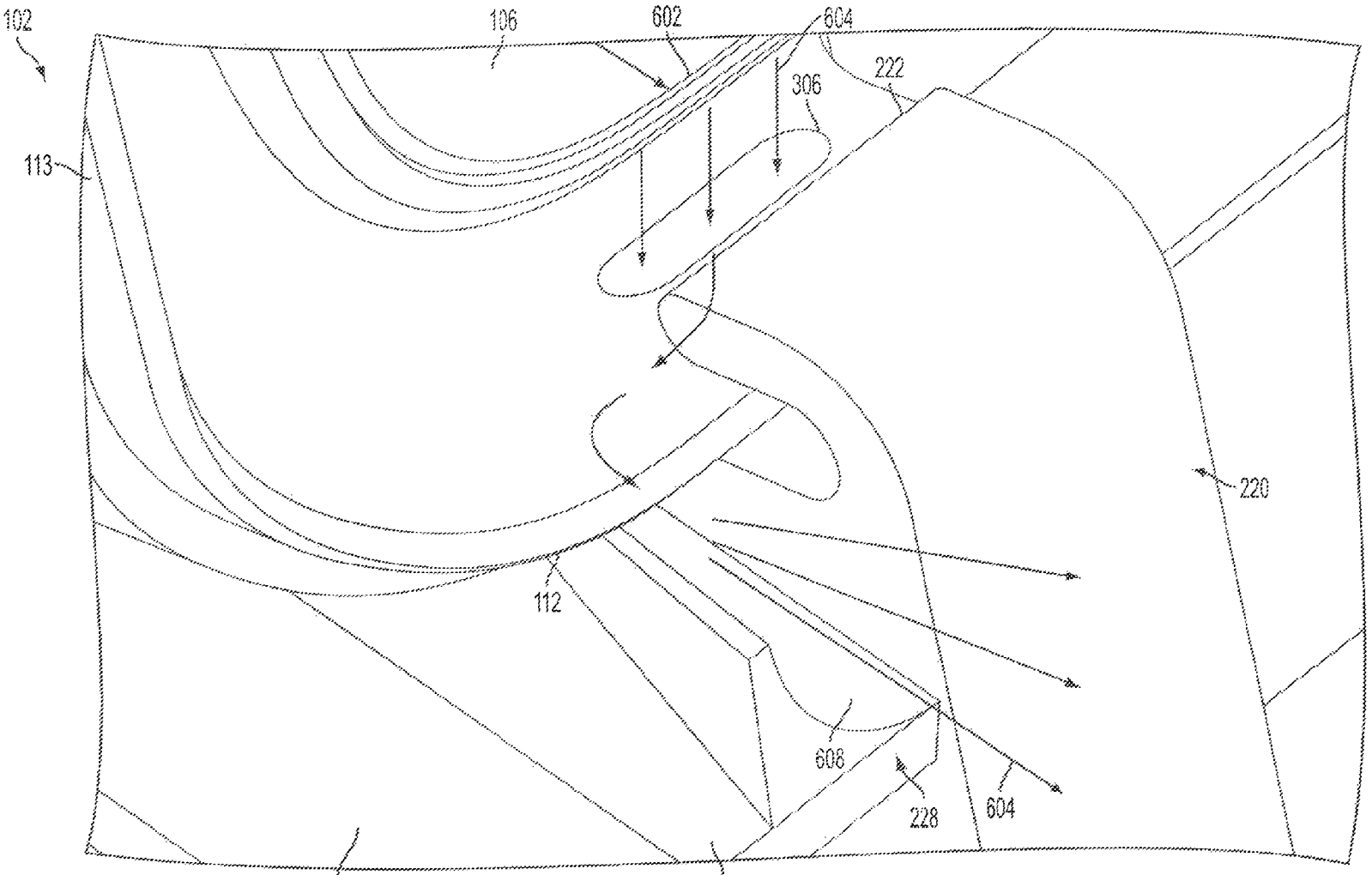
FIG. 7 is an enlarged view of a portion of the interface between the base and the lid of FIG. 6.

As best seen in FIG. 7, acoustic opening 306 in lid 102 is configured to line up with a speaker 602 of item 106. Arrows 604 show the direction of sound waves from speaker 602, through acoustic opening 306, and out through acoustic amplifier 228. Acoustic amplifier 228 is in the form of a generally conically shaped projection 606 having a curved side wall 608. However, any suitable shape for directing sound can be used. When the conically shaped projection is aligned with speaker 602, the two pieces create a path through which sound may be passed through and amplified. Acoustic amplifier 228 is located on top of one of flanges 208. For example, base 104 is configured to receive item 106 having a speaker located on the left end of the bottom side of item 106. Opening 306 in lid 102 is configured to line up with the speaker on item 106. As a result, when item 106 is placed in lid 102 and sound is produced through speaker 602, the sound travels through acoustic opening 306 in lid 102 and is directed by acoustic amplifier 228 towards the front of lid 102, amplifying sound from speaker 602.

In another embodiment, acoustic amplifier 228 is directed towards base 104 itself, which allows the base to also serve as an acoustic amplifier. Acoustic opening 306 can serve as an opening to direct the sound or one or more additional openings can be formed in base 104 to direct sound therethrough.

Base 104 may additionally be configured to accommodate electrical components such as an infrared (IR) sensor, an audio "line out", or a female-to-male plug adaptor. These components could serve to better replicate the functions of a conventional docking station. In one embodiment, a circuit board embedded into base 104 of packaging 100 includes these components. In another embodiment, a custom accessory could be integrated or otherwise added to packaging 100.

Figure 8B:
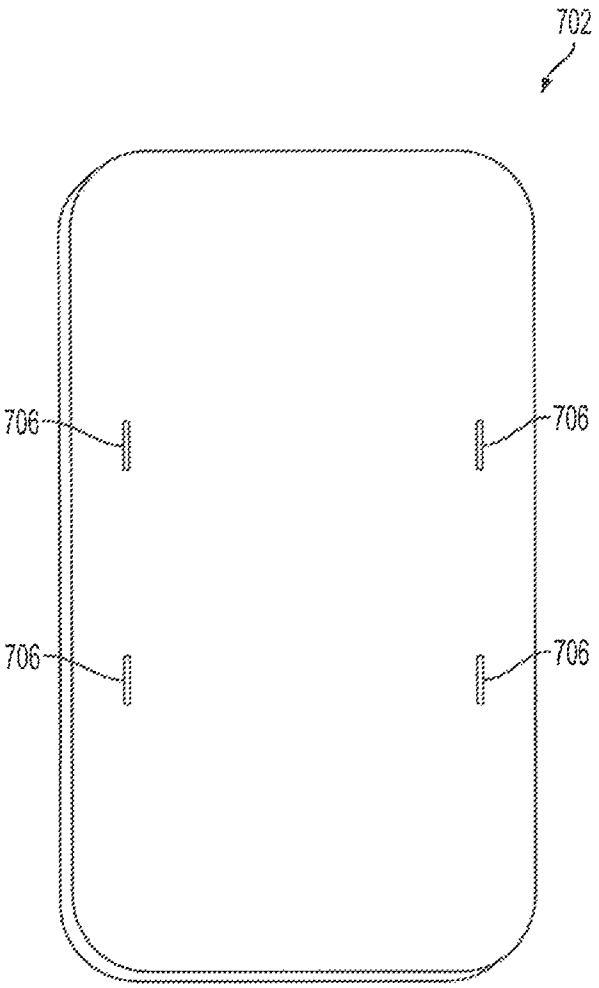
FIG. 8*b* is a back perspective view of the insert of FIG. 8*a*.
Figure 8A:
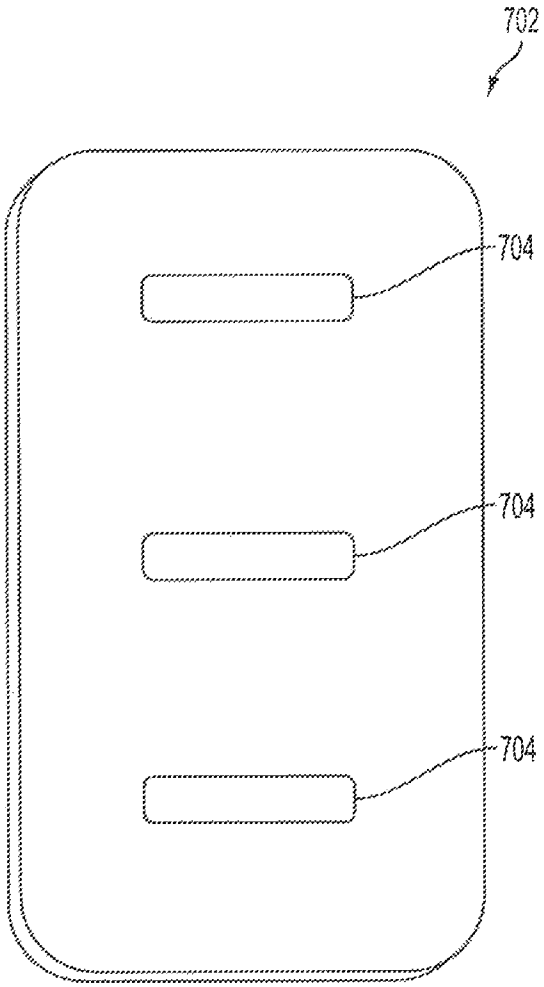
FIG. 8*a* is a front perspective view of an insert for use with the packaging of FIG. 1.
Figure 9:
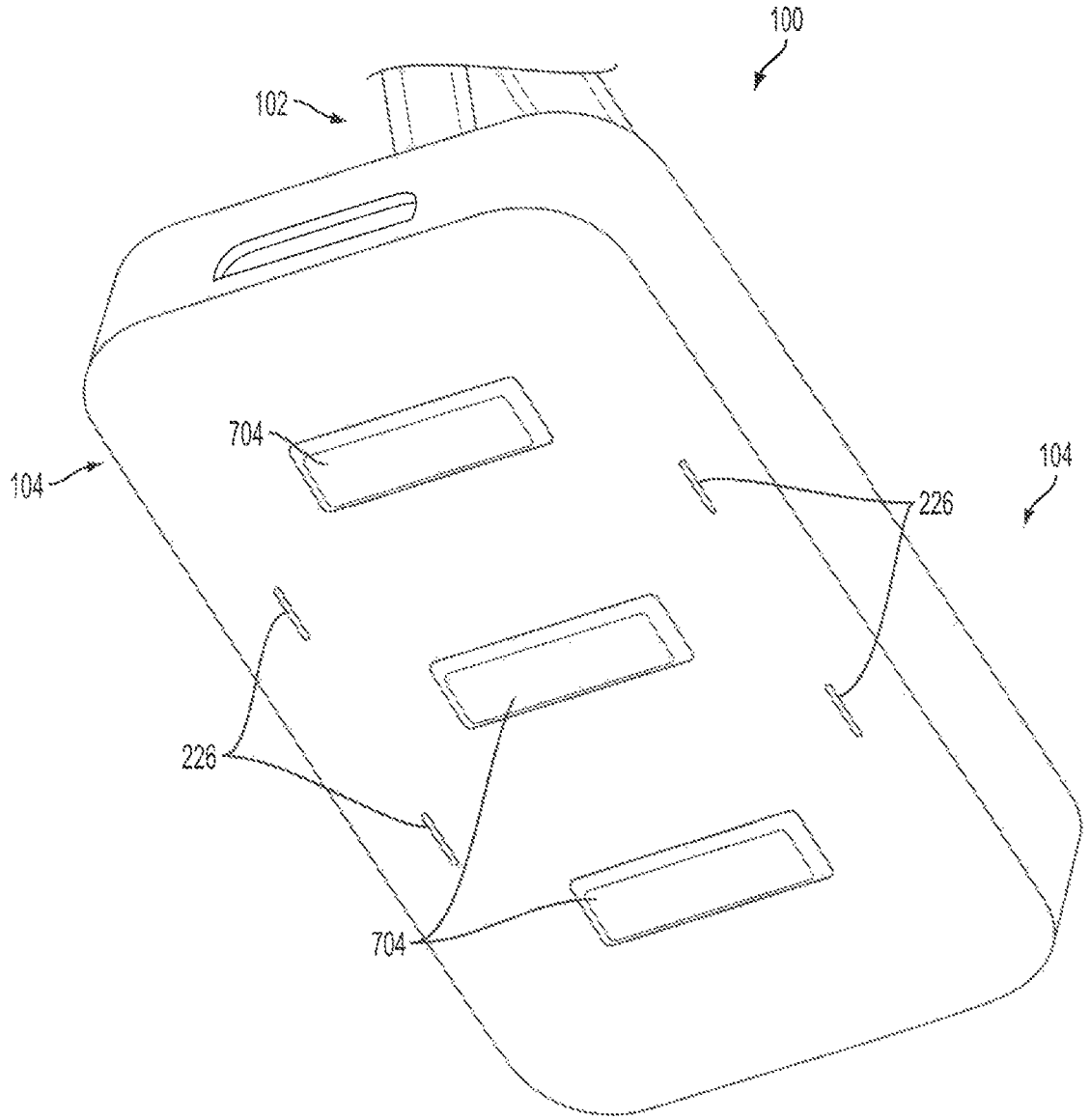
FIG. 9 is a bottom perspective view of the packaging of FIG. 1 in a display configuration including the insert of FIG. 8.

FIG. 8*a* is a front perspective view of an insert 702 for use with packaging 100. Insert 702 is a substantially planar piece of thin plastic, however, other suitable materials and shapes may be used. Insert 702 includes friction pads 704 which serve to minimize movement between packaging 100 and a support surface, such as a desk or a table or merely to elevate packaging 100 above the support surface when place on the bottom 802 of base 104, as shown in FIG. 9. Insert 702 includes three friction pads 704 located on one side of insert 702. However, a greater number or lesser number of friction pads can be used as desired. Friction pads 704 are shown as thin and substantially rectangular, however, they can be any other suitable shape and size. Additionally, friction pads 704 can be located on both sides of insert 702, on the side of insert 702, or any other suitable location. Insert 702 may be disposed in base 104 to support item 106 in the packaging configuration after the individual opens packaging 100, they may choose to place insert 702 on the bottom of base 104, as shown in FIG. 9, to create a relatively non-slip surface for base 104. In other embodiments, friction pads 704 can additionally or alternatively be located directly on the bottom of base 104 or can be included in packaging 100 for a user to attach to either insert 702 or base 104.

FIG. 8*b* is a back perspective view of insert 702. Insert 702 includes mating connections 706 in the form of four rectangular protrusions that project from insert 702. Mating connections 706 are configured to engage with corresponding mating connection openings 226 in base 104 to secure insert 702 to base 104. In addition or in the alternative, insert 702 can engage with base 104 via snaps, latches, spring detents, magnets, or the like. Other more permanent attachment means can be used, such as adhesive, which provides for permanent or removable attachment between lid 102, base 104, and insert 702.

Figure 10:
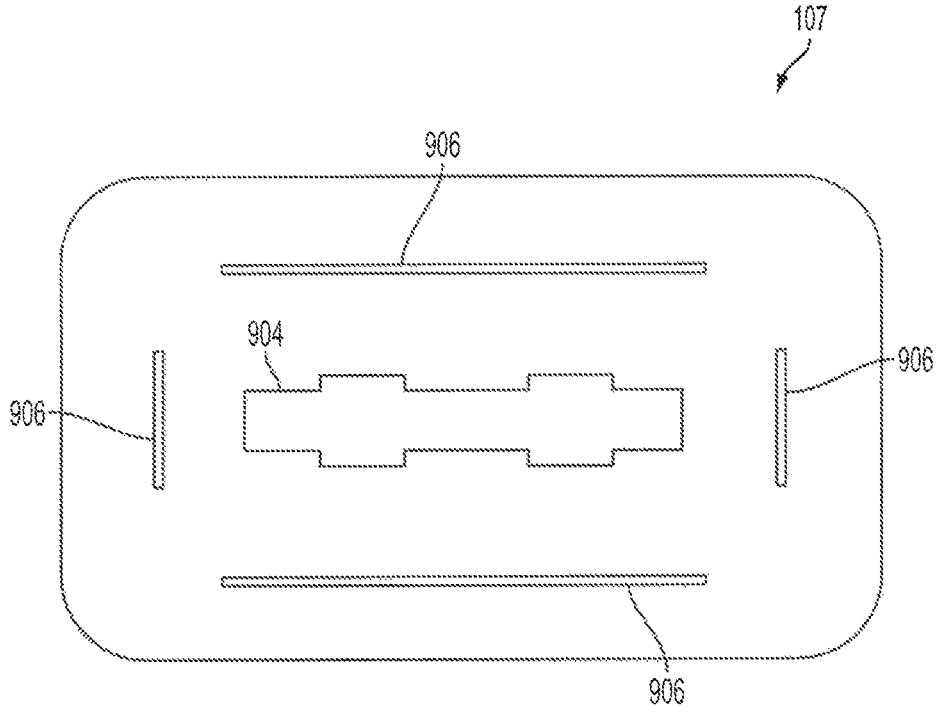
FIG. 10 is a top view of another insert for use with the packaging of FIG. 1.

FIG. 10 is a top view of insert 107 for use with packaging 100. Insert 107 is a substantially planar, rectangular, thin piece of plastic. Insert 107 can additionally or alternatively be made of paper, thin cardboard, or any other suitable material. Insert 107 includes an attachment support opening 904 that allows insert 107 to slide over attachment supports 220 of base 104 and rest on ledge 116 of base 104 to cover cavity 206 in base 104 when in the display configuration. Insert 107 has a peripheral surface sized to fit closely within side walls 204 and 205 of base 104 and attachment support opening 904 sized to fit closely over attachment supports 220 of base 104 so that insert 107 substantially covers the interior of base 104 when insert 107 is placed on base 104. However, attachment support opening 904 can have other suitable shapes or sizes which are compatible with attachment supports 220.

Insert 107 is configured to be supported by ledge 116 of base 104 in the packaging configuration and item 106 rests on it. In another embodiment, insert 107 is configured to rest on flanges 208 of base 104. When assembled in the dispensing configuration, insert 107 provides a cleaner look to packaging 100 by substantially covering up cavity 206 formed in base 104. Insert 107 may serve other uses including but not limited to, limiting access to cavity 206.

Insert 107 includes slots 906 which are configured to allow for packaging materials, such as cellophane, plastic wrapping, tape, or other material to pass therethrough which can serve to secure item 106 to insert 107 in the packaging configuration or for any other purpose. Insert 107 can additionally include flanges (not shown) or other protrusions or openings in order to facilitate removing insert 107 from base 104. In some embodiments, a protrusion formed on insert 107 is sized to substantially mate with a corresponding opening in lid 102 to cover opening 304 in the display configuration or packaging configuration or both. The flanges, protrusions or openings can be located on lengthwise or widthwise ends of insert 107. In one embodiment, insert 107 includes friction pads similar to friction pads 704 and mating connections similar to mating connections 706 of insert 702. This configuration allows a user the option of using insert 107 for increased stability between base 104 and a support surface via friction pads 704 or using insert 107 to cover up cavity 206 in base 104. In one embodiment, separate pieces serving one or more functions of insert 702 and insert 107 are included in the same packaging.

Figure 11:
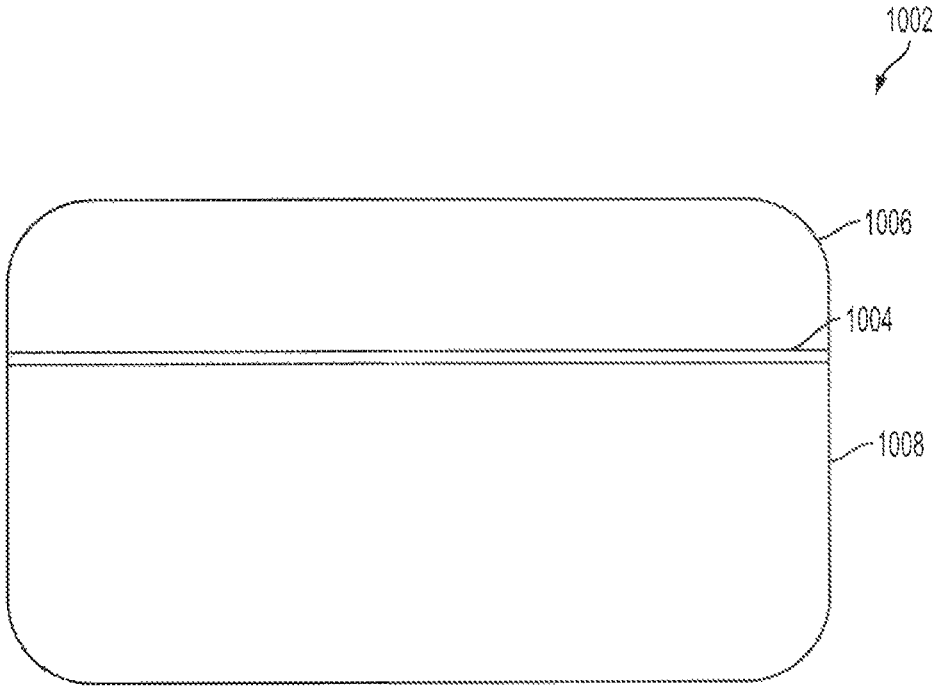
FIG. 11 is a top view of another insert for use with another embodiment of packaging of the present invention.

FIG. 11 is a top view of another insert 1002 configured for use with another embodiment of packaging 100. Like insert 702, insert 1002 is a substantially planar, rectangular, thin piece of material. Insert 1002 includes a living hinge 1004 that extends across the lengthwise, or longitudinal, dimension of insert 1002 and defines a back portion 1006 and a front portion 1008. Alternatively, living hinge 1004 can be located diagonally across insert 1002 or any other suitable angle. Insert 1002 can be made of plastic, such as polyethylene or polypropylene, or any other suitable material, to allow insert 1002 to bend along the line of the hinge. Insert 1002 can be manufactured in an injection molding operation that creates the living hinge, back portion, and front portion at one time as a single part. Alternatively, the living hinge can be a surface coating on one or more pieces, or can be a separate piece attached to the one or more pieces. Other forms of hinge 1004 can be used, such as a barrel hinge or any other suitable configuration that allows for relative movement between portions 1006 and 1008.

Figure 12:
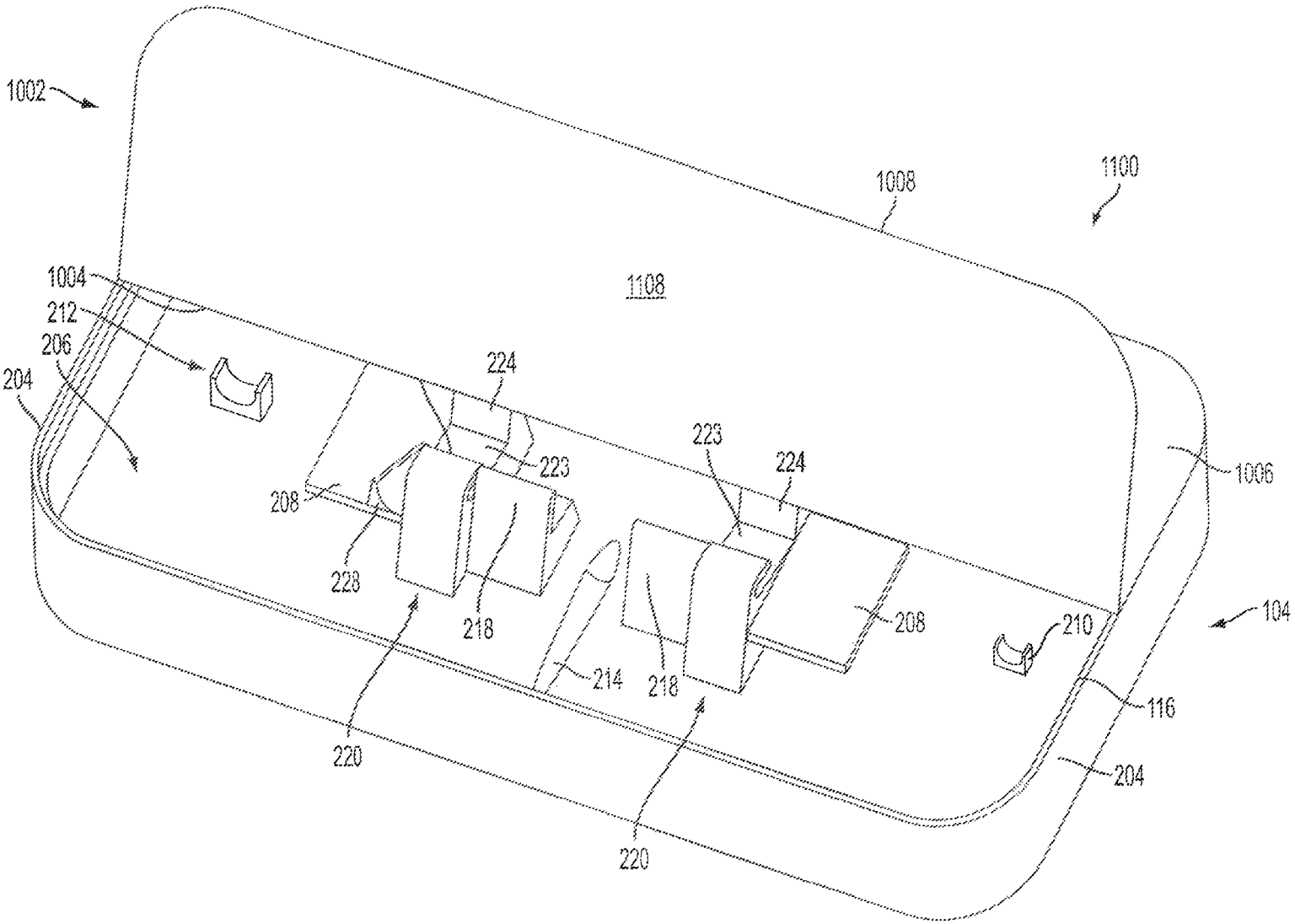
FIG. 12 is a front perspective view of packaging in a display configuration with the insert of FIG. 11.

FIG. 12 is a front perspective view of packaging 1100 in a display configuration with insert 1002. Packaging 1100 includes base 104 having ledge 116 and attachment supports 220. In this configuration, back portion 1006 of insert 1002 rests on ledge 116 of base 104 and front portion 1008 can serve one or more functions of both lid 102 (described for example with respect to FIG. 1) and lid support 224 (described for example with respect to FIG. 2). That is, front surface 1108 of insert 1002 can support an item (not shown) disposed within packaging 1100. If the item is removed from packaging 1100, front portion 1008 of insert 1002 can be lowered to cover cavity 206 in base 104. One or more additional living hinges can be included in insert 1002 to allow for additional flexure pivots in either front portion 1008 or back portion 1006. An additional living hinge in back portion 1006, for example, could facilitate access to the interior or inner space, such as cavity 206 of base 104 without having to remove insert 1002. A separate cover, similar to lid 102 of FIG. 1 can be used to cover packaging 1100 for packaging or insert 1002 itself can be used to cover packaging 1100 for packaging. In use, an individual removes item 106 from packaging 1100. After item 106 is removed, the individual bends front portion 1008 of insert 1002 upright and towards back portion 1006 of insert 1002. Once front portion 1008 is adjusted to a desirable angle, the individual can place item 106 on attachment supports 220 and against front surface 1108 of insert 1002. In so doing, attachment supports 220 and front surface 1108 of insert 1002 both support item 106 in a substantially upright position.

Like the embodiment shown in FIGS. 2 and 6, attachment supports 220 of base 104 include lid supports 224, which are configured to support the back surface of lid 102 for increased stability between lid 102 and base 104 and to reduce pressure on hooks 222. Power cord 502 (not shown) can be passed through cord opening 216 (shown in FIG. 2) of base 104 and secured in place by projection 210. Power cord 502 can wrap around the front of attachment supports 220 and is supported by plug support 218. Packaging 100 can also accommodate other arrangements of power cord 502.

Insert 1002 is shown as a separate piece from base 104. However, insert 1002 can combined with base 104 in a single monolithic piece, or can be attached via a tongue-and-groove arrangement, a friction fit, a fastener, snaps, latches, spring detents, magnets, or any other suitable attachment means.

Figure 13:
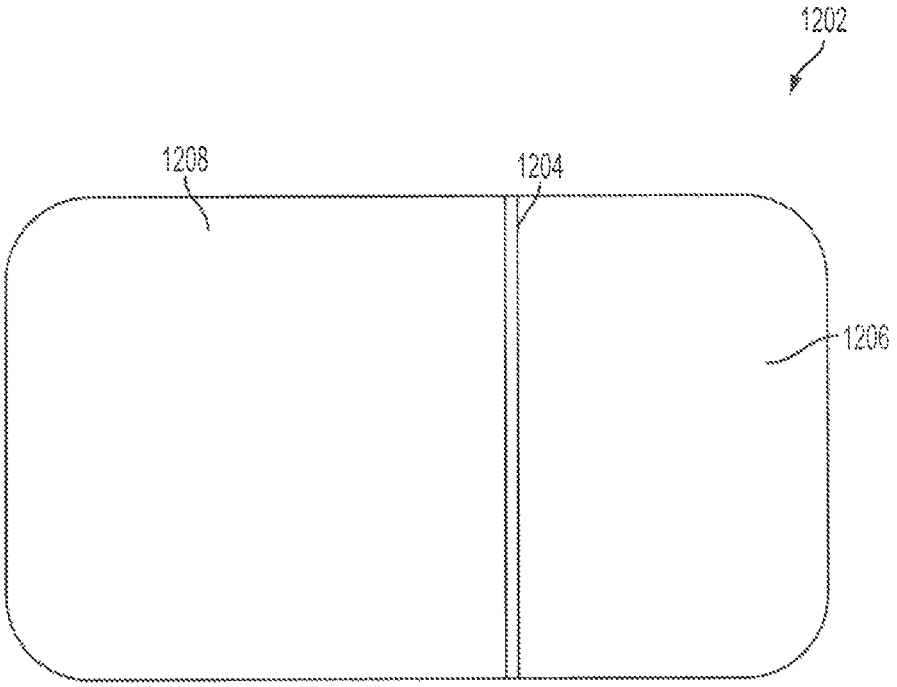
FIG. 13 is a top view of another insert for use with another embodiment of packaging of the present invention.

FIG. 13 is a top view of another insert 1202 configured for use with another embodiment of packaging 100. Like insert 1002, insert 1202 includes a living hinge 1204, which defines a back portion 1206 and a front portion 1208. Living hinge 1204 extends across the widthwise dimension of insert 1202 and is configured for use with a base having attachment supports rotated to face a widthwise direction (not shown). Similar to insert 1002, in use, an individual removes item 106 from the packaging (not shown). After item 106 is removed, the individual bends front portion 1208 of insert 1202 upright and towards back portion 1206 of insert 1202. Once front portion 1208 is adjusted to a desirable angle, the individual can place item 106 on attachment supports (not shown) and against front surface (not shown) of insert 1202. In so doing, the attachment supports and front surface of insert 1202 both support item 106 in a substantially upright position.

Figure 14:
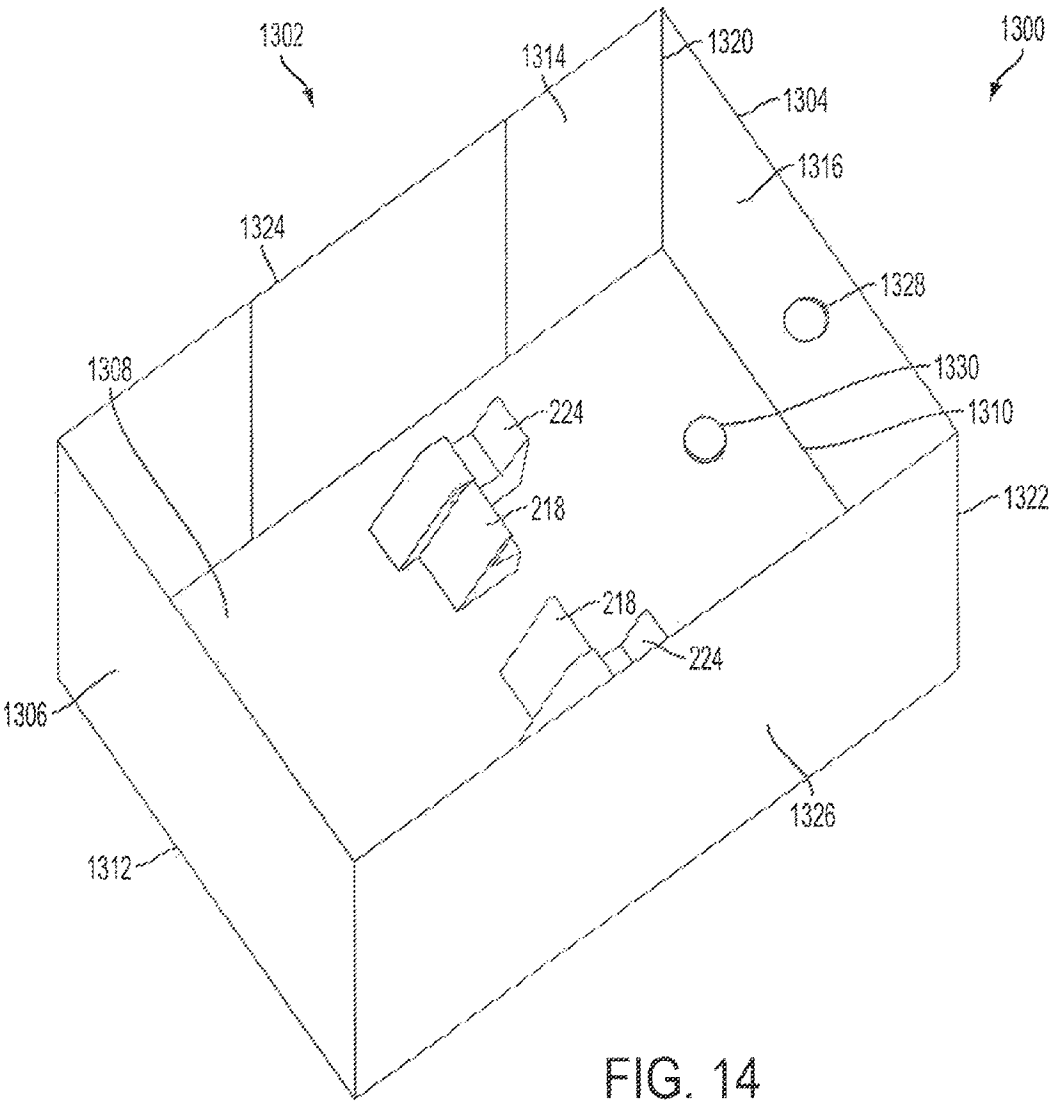
FIG. 14 is a front perspective view of another embodiment of packaging of the present invention in a first configuration.
Figure 15:
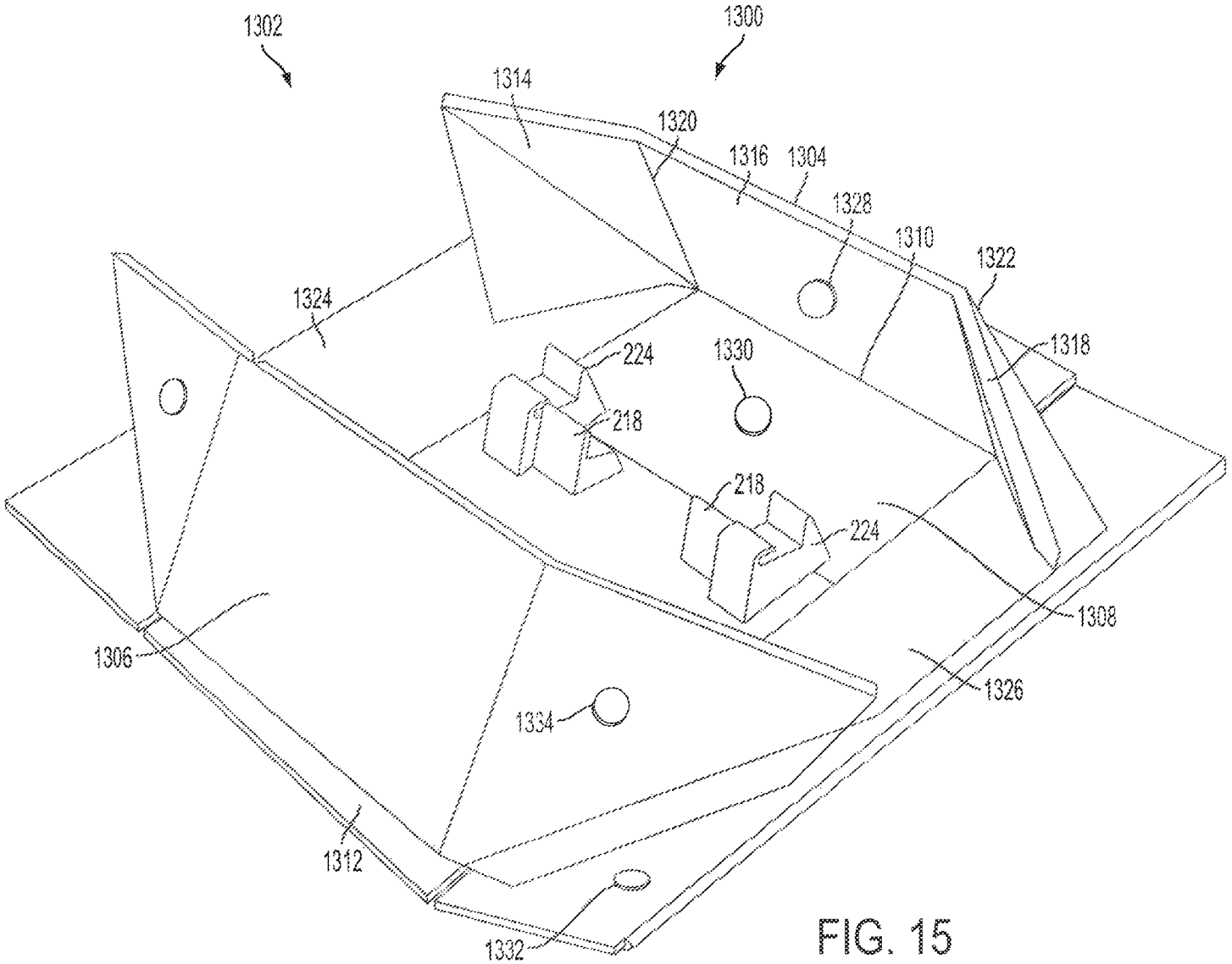
FIG. 15 is a front perspective view of the packaging of FIG. 14 in a second configuration.

In another embodiment, base 104 itself may be configured to expose attachment supports 220 on which item 106 contained in packaging 100 may be displayed. FIG. 14 is a front perspective view of packaging 1300 in a substantially upright configuration and FIG. 15 is a front perspective view of packaging 1300 in a partially collapsed configuration. Packaging 1300 includes a lid (not shown) and attachment supports similar to attachment supports 220 shown, for example in FIG. 2. Attachment supports of packaging 1300 can be in the form of a solid piece of material that protrudes from bottom wall 1308 of base 104. Attachment supports of packaging 1300 include a hook configured to removably attach to side wall 112 of lid 102 (shown, for example in FIG. 3). However, any other suitable attachment means, such as a tongue-and-groove arrangement, a friction fit arrangement, snaps, latches, spring detents, magnets, or the like can alternatively or additionally be used. Other more permanent attachment means can be used, such as adhesive for example, which provides for permanent or removable attachment between attachment supports 220 and lid 102.

Packaging 1300 further includes base 1302 which is able to transform into more than one configuration through the use of hinges. For example, base 1302 includes a first wall 1304 and a second wall 1306 which are flexibly attached to a bottom wall 1308. First wall 1304 and second wall 1306 are configured to move with respect to bottom wall 1308 around a corresponding pivot (pivot 1310 for the first wall and pivot 1312 for the second wall).

Each of first wall 1304 and second wall 1306 include a plurality of sections, such as first section 1314, second section 1316, and third section 1318. First section 1314 is flexibly attached to second section via pivot 1320, second section 1316 is flexibly attached to third section 1318 via pivot 1322, and second section is attached to bottom wall via pivot 1312. First section 1314 is flexibly attached to a third wall 1324. Third section 1318 is flexibly attached to a fourth wall 1326.

Any or all of the pivots described herein can be in the form of hinges, such as a living hinge, a barrel hinge, or any other suitable configuration that allows for relative movement between the various pieces or sections.

Base 1302 additionally includes various magnets and ferromagnetic materials configured to engage with the magnets. For example, second section 1316 includes a magnet 1328 embedded therein and bottom wall 1308 includes a ferromagnetic material 1330 embedded therein. In another embodiment, the ferromagnetic material can be embedded in the second section and the magnet can be embedded in the bottom wall. Magnet 1328 and ferromagnetic material 1330 are positioned such that when second section 1316 is rotated around pivot 1312, at a predetermined distance, magnet 1328 is close enough to ferromagnetic material 1330 to provide a force causing second section 1316 to collapse against bottom wall 1308. The force of the attraction between magnet 1328 and ferromagnetic material 1330 is weak enough to allow an individual to pull second section 1316 apart from bottom wall 1308 while still securing second section 1316 to bottom wall 1308. Second wall 1306 includes a comparable arrangement of a magnet 1332 and ferromagnetic material 1334 in order to orient packaging 1300 in an upright configuration.

In one embodiment, base 1302 includes additional magnets and ferromagnetic material arrangements such that base 1302 has substantially at least two relatively fixed configurations. A first configuration corresponding to a collapsed configuration (not shown) is provided wherein second section 1316 adjoins bottom wall at the location of magnet 1328 and first wall 1304, second wall 1306, third wall 1324, and fourth wall 1326 lie substantially flat.

In the substantially upright configuration, first wall 1304, second wall 1306, third wall 1324, and fourth wall 1326 can be lifted substantially upright such that base 1302 is in a substantially box-like shape. Magnets and ferromagnetic materials are arranged in suitable locations in base 1302 so that base 1302 can snap into either the first position or second position depending on an individual's preference. The magnets and ferromagnetic materials can be embedded in the various walls or can be disposed on an outside surface thereof.

In use, the individual can pull third wall 1324 and fourth wall 1326 away from each other, which moves first wall 1304 and second wall 1306 toward bottom wall 1308. When first wall 1304 and second wall 1306 are a predetermined distance from bottom wall, magnet 1328 is close enough to ferromagnetic material 1330 to provide a force causing first wall 1304 and second wall 1306 to collapse against bottom wall 1308. To put packaging 1300 in its substantially upright configuration, an individual can lift third wall 1324 and fourth wall 1326 towards each other, which likewise lifts first wall 1304 and second wall 1306. When third wall 1324 and fourth wall 1326 are a predetermined distance from the magnets (not shown) embedded in first section 1314 and third section 1318, the magnets are close enough to the ferromagnetic material embedded in third wall 1324 and fourth wall 1326 to provide a force causing third wall 1324 and fourth wall 1326 to snap against first wall 1304 and second wall 1306.

An individual can place lid 102 within attachment support of packaging 1300 similar to the embodiment shown for example in FIG. 5. That is, short side wall 112 of lid 102 is placed within a groove (such as groove 227 in FIG. 3) formed by a hook in attachment support of packaging 1300. Like the embodiment of FIG. 4, the hook serves to securely support short side wall 112 of lid 102 so that lid 102 is displayed in a substantially upright orientation. Once lid 102 is supported within attachment support 220, an individual may place item 106 within cavity 302 of lid 102 to be displayed within lid 102. Like attachment support 220, attachment support of packaging 1300 is configured to raise lid 102 above base 1302 to create a gap under lid 102 to receive a plug (such as dock connector 504 shown in FIG. 6).

While the invention has been described in terms of several preferred embodiments, there are alterations, permutations, and equivalents, which fall within the scope of this invention. The breadth and scope of the present invention should not be limited by any of the above-described exemplary embodiments or examples, but should be defined only in accordance with the following claims and their equivalents.

The invention claimed is:

1. A packaging system, comprising:

packaging comprising a peripheral sidewall disposed around and extending perpendicularly from a lower surface, the peripheral sidewall and the lower surface forming a cavity;

a power opening through the peripheral sidewall;

a charging element at least partially disposed within the cavity, where the charging element extends perpendicularly relative to the lower surface and is spaced apart from the lower surface of the cavity by a support element;

a power cord extending from the power opening to the charging element, for providing power to the charging element.

2. The system of claim 1, wherein the charging element is elevated above the lower surface by the support element.

3. The system of claim 1, further comprising an item-support surface disposed within the cavity, wherein the charging element is elevated above the lower surface by the support element, and wherein the support element extends through the item-support surface.

4. The system of claim 1, further comprising an acoustic amplifier.

5. A packaging system, comprising:

packaging forming a cavity for at least partially containing an electronic device;

an item-support surface disposed within the cavity for supporting the electronic device, wherein the item-support surface defines an opening therethrough;

a charging element at least partially disposed above the item-support surface, a support element supporting the charging element, wherein the support element extends through the opening in the item-support surface, wherein the charging element is configured to provide power to the electronic device.

6. The system of claim 5, wherein the charging element is configured to provide power to the electronic device through a physical connection to the electronic device.

7. The system of claim 5, wherein the charging element is configured to provide power to the electronic device through a wired connection to the electronic device.

8. The system of claim 5, wherein the charging element is configured to provide power to the electronic device by being plugged into the electronic device.

9. The system of claim 5, wherein the support element supports the charging element in an upright orientation with respect to the item-support surface.

10. The system of claim 5, further comprising an acoustic amplifier.

* * * * *